US006230357B1

(12) United States Patent
Davis

(10) Patent No.: US 6,230,357 B1
(45) Date of Patent: May 15, 2001

(54) PAINTBRUSH HANDLE AND APPLICATOR CARTRIDGE

(76) Inventor: Art Davis, 9136 De Soto Ave., Chatsworth, CA (US) 91311

( * ) Notice: Subject to any disclaimer, the term of this patent is extended or adjusted under 35 U.S.C. 154(b) by 0 days.

(21) Appl. No.: 09/209,159

(22) Filed: Dec. 10, 1998

(51) Int. Cl.[7] ..... A46B 7/00
(52) U.S. Cl. ..... 15/176.3; 15/176.1; 15/145
(58) Field of Search ..... 15/144.3, 145, 15/146, 172, 176.1, 176.2, 176.3, 176.4, 176.5, 176.6

(56) References Cited

U.S. PATENT DOCUMENTS

| | | | | |
|---|---|---|---|---|
| 2,526,756 | * | 10/1950 | Krebs | 15/176.3 |
| 2,558,290 | | 6/1951 | Brown . | |
| 3,596,304 | * | 8/1971 | Welt | 15/144.3 |
| 3,757,376 | | 9/1973 | Coombes . | |
| 3,874,021 | | 4/1975 | Jacobs . | |
| 3,994,039 | * | 11/1976 | Hadary | 15/172 |
| 4,469,223 | | 9/1984 | Smith . | |
| 4,494,268 | | 1/1985 | Chu . | |
| 5,226,198 | * | 7/1993 | Martin | 15/176.3 |
| 5,366,314 | * | 11/1994 | Young | 15/145 |
| 5,926,903 | * | 7/1999 | Kim | 15/176.1 |

FOREIGN PATENT DOCUMENTS

| | | | |
|---|---|---|---|
| 606938 | * | 6/1926 | (FR) . |
| 122293 | * | 2/1918 | (GB) . |

* cited by examiner

*Primary Examiner*—Randall E. Chin
(74) *Attorney, Agent, or Firm*—Colin P. Abrahams

(57) ABSTRACT

A paintbrush comprises a handle portion including a stem portion and a head portion, with the head portion having a receiving means thereon. The paintbrush also has a paint application cartridge having a paint application portion, and a holding means for holding the paint application portion. A connecting means for connecting the paint application cartridge releasably to the receiving means of the handle portion is provided.

27 Claims, 2 Drawing Sheets

FIG. 1
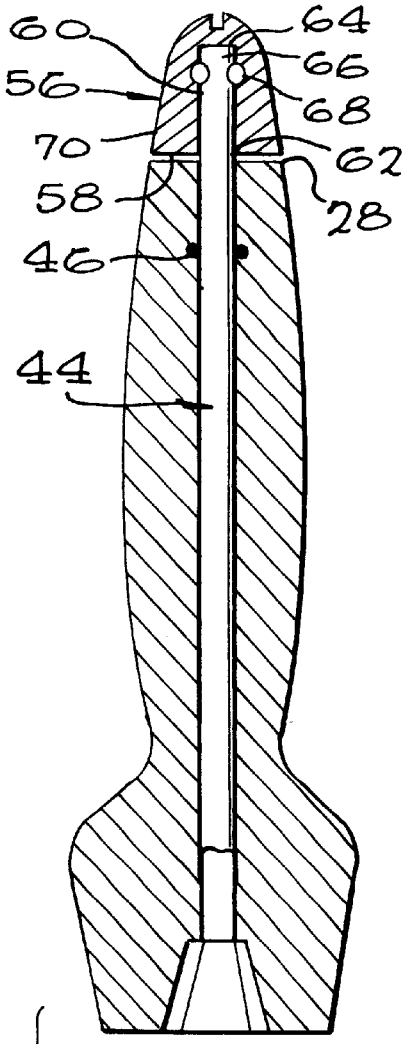
FIG. 2
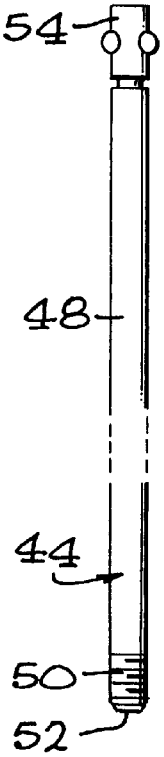
FIG. 4
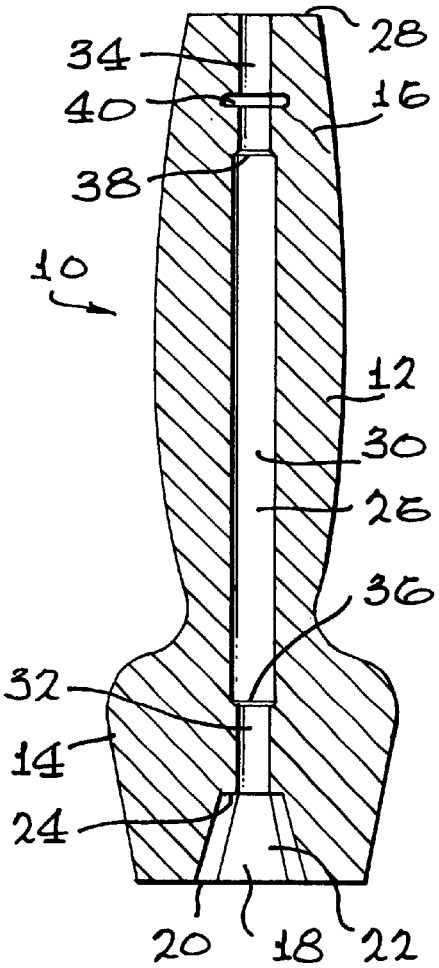
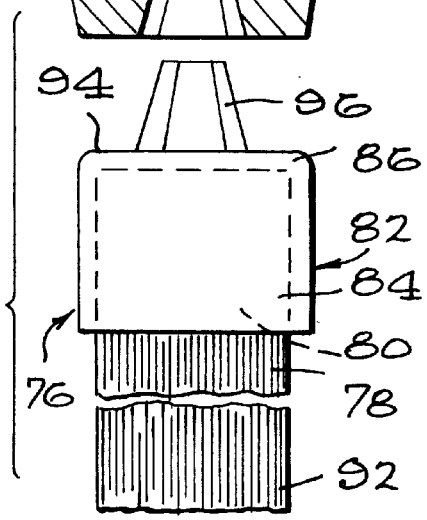
FIG. 3
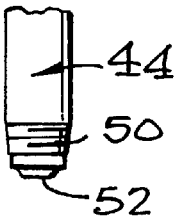
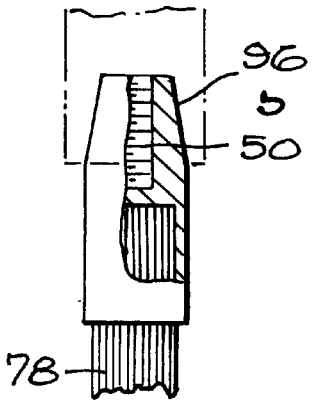
FIG. 5(b)

FIG. 5(a)
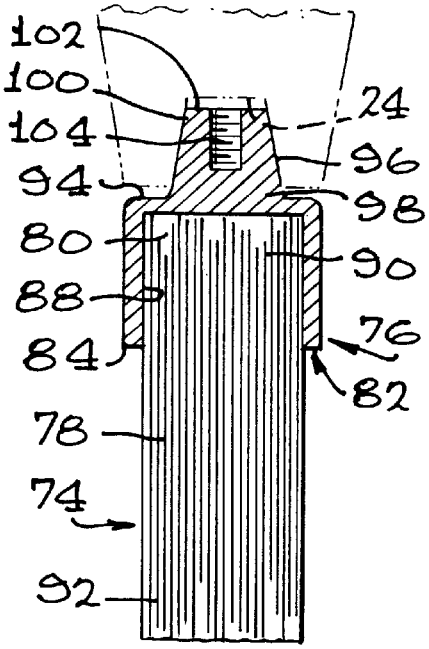
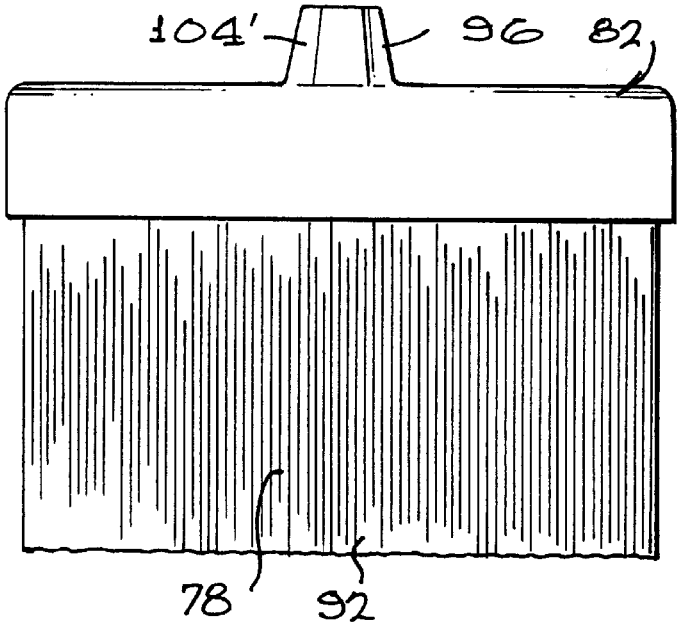
FIG. 6(a)
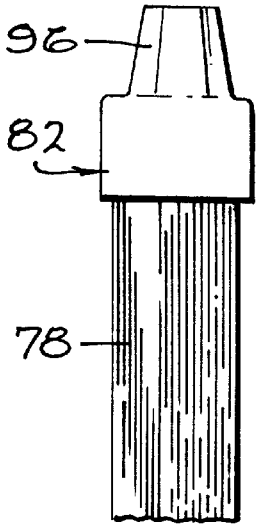
FIG. 6(b)
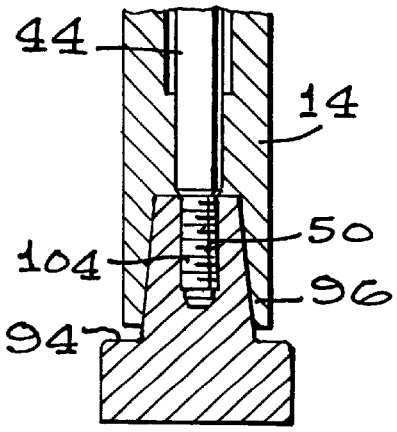
FIG. 7
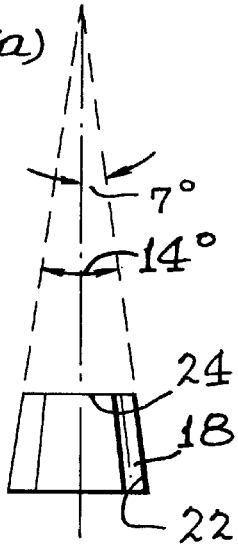
FIG. 8(b)
FIG. 8(a)
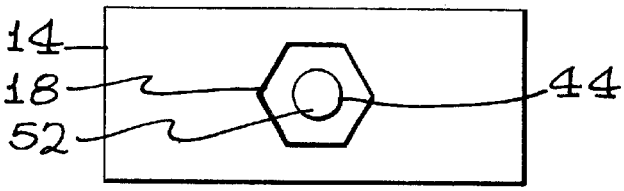
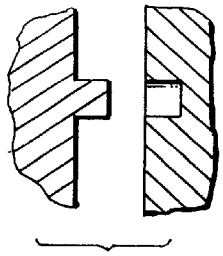
FIG. 9

PAINTBRUSH HANDLE AND APPLICATOR CARTRIDGE

BACKGROUND OF THE INVENTION

This invention relates generally to paintbrushes, and more particularly to paintbrushes having a handle portion and a paint applicator portion, the handle portion and paint applicator portion being releasably connectable to each other.

In this specification, the term "paintbrush" is intended to include a paint application portion which may be comprised of bristles to form a brush, is a roller having an outer fabric surface, or is any other medium by which paint may be applied to a surface.

Paintbrushes are, of course, well known articles for applying paint to surfaces. A typical brush comprises a contoured handle which is elongate, and a plurality of bristles at one end thereof, held together to form a brush. The plurality of bristles are permanently attached to the one end of the handle, usually by means of a metal ring or bracket. Since the bristles, or brush, is permanently affixed to the handle in most paintbrush arrangements, a particular paintbrush will be limited to specific uses, and will often only be used once before being discarded. This is because many users prefer to simply discard a paintbrush rather than go through the messy and time consuming task of cleaning the brush.

The brush portion of the paintbrush may have a variety of different forms and constituents. Thus, brushes may vary in width, from, for example, a half inch width right up to a width of five to six inches and more. Smaller width brushes are suitable for painting strips, edges or corners, and are useful where finer paintwork is required. On the other hand, a much wider bristle or brush component would be used to cover surfaces with paint much more quickly, and where broader stroke and wider area application of the paint is required.

One of the problems with respect to conventional paintbrushes is that painting jobs may typically require brushes having different sizes and attributes. Thus, smaller width brushes are required for edges, while wider width brushes are required for larger surface areas to be painted. Moreover, the nature and quality of the bristles which for the brush have optimal uses in different situations. In some instances, nylon-type bristles may be appropriate, while in others, softer more natural-type bristles are needed. In yet other circumstances, the painting portion need not necessarily be a brush, but may comprise a sponge, fiber or other appropriate material. To properly carry out a painting job may therefore require a painter to have an arsenal of different shaped, sized and quality brushes, which may be difficult to store, expensive to obtain, and somewhat inconvenient to use.

SUMMARY OF THE INVENTION

According to one aspect of the invention, there is provided a paintbrush comprising: a handle portion including a stem portion and a head portion, the head portion having a receiving means thereon; a paint application cartridge having a paint application portion, a holding means for holding the paint application portion, and a connecting means whereby the paint application cartridge can be releasably connected to the receiving means of the handle portion.

Preferably, the receiving means comprises a recess in the head portion, and a fastening means in the recess portion for releasable connection to the connecting means. The fastening means may comprise a bolt located in the handle portion, the bolt having a threaded end which engages with the connection means of the paint applicator cartridge. The handle portion may include a channel extending therethrough from the receiving means at the head portion to an opposite end of the head portion, with the bolt being located in the channel. The bolt preferably comprises a ring portion thereon, the ring portion permitting rotational movement of the bolt within the channel, but preventing axial movement of the bolt therein.

In one embodiment, the handle portion further comprises a knob connected to the bolt at an end thereof remote from the threaded portion, whereby rotation of the knob causes rotation of the bolt and the subsequent attachment to or release from the connecting means of the paint application cartridge. The bolt may comprise at least one projection extending radially outwardly from the bolt, with the knob being molded around the projection. Further, the handle portion may further include a retaining ring groove, wherein the ring portion on the bolt is accommodated.

Preferably, the channel comprises a central portion having a diameter slightly wider than the bolt and two end portions each having a diameter substantially the same as the bolt.

The paint application portion, in one form, comprises a medium selected from the group consisting of: nylon bristles, synthetic bristles, natural bristles, and fabric. The paint application cartridge may be a brush or a roller.

The holding means preferably comprises a cup-shaped member having side walls and a base which define a chamber, with a portion of the paint application portion being located within the chamber. The connecting means may comprise a connector piece extending from the base wall of the cup member in a direction away from the chamber. The connector piece may have a central groove therein having an internal thread, the groove receiving a threaded bolt member which forms part of the receiving means. Further, the connector piece may be of hexagonal shape, and taper from a wider diameter portion at a point near the cup-shaped member to a narrower diameter portion at a point remote from the cup member.

According to another aspect of the invention, there is provided a paint brush handle connectable to a paint applicator having a connecting member thereon, the paint brush handle comprising a stem portion contoured for holding by a user of the paint brush handle; a head portion at one end of the stem portion, the head portion having a receiving member for receiving the connecting member of the paint applicator; and fastening means within the receiving member for releasably attaching to the connecting member.

In still a further aspect of the invention,there is provided a paint applicator cartridge connectable to a paint brush handle having a receiving means thereon, the paint applicator cartridge comprising a paint applicator portion for absorbing paint and whereby the paint is applied to a surface; a holding member for securely holding the paint applicator portion; and connecting means on the holding member for releasably connecting the paint applicator cartridge to the receiving means on the paint brush handle.

The invention is also for a method of assembling a paintbrush having a handle and a paint application cartridge, the method comprising forming a receiving member in the handle capable of releasably receiving the cartridge portion; forming a connector piece on the cartridge having a shape and configuration corresponding to the receiving means; and locating the connector piece releasably within the receiving means.

The present invention therefore addresses the problem of multiple-type paintbrush heads which may be required by providing a separate handle portion, and a paint application portion in the form of a cartridge which may be releasably and effectively removed from the handle portion when a different paint application portion is needed. In one form, the paintbrush of the invention comprises a handle with a receiving means, and a paint application portion with a registering or corresponding connector, whereby the handle portion may be connected, serially, with a wide variety of different paint application portions depending upon the preferences and requirements of the user.

BRIEF DESCRIPTION OF THE DRAWINGS

FIG. 1 is a front view of the handle portion and paint application portion of the paintbrush assembly of the invention;

FIG. 2 is a side view of a bolt located in the handle portion of the paintbrush assembly with connecting means for attachment to the paint application portion;

FIG. 3 is a detail of the threaded end of the bolt shown in FIG. 2;

FIG. 4 is a sectional view of the handle portion only with the bolt and knob removed and showing the bolt receiving channel;

FIG. 5(*a*) is a top view of a paint application portion attachable to the handle portion, shown in phantom lines, to form the paintbrush assembly of the invention;

FIG. 5(*b*) is a side view of the paint application portion shown in FIG. 5(*a*);

FIG. 6(*a*) is a is a top view of a wider paint application portion attachable to the handle portion to form the paintbrush assembly;

FIG. 6(*b*) is a side view of a wider paint application portion shown in FIG. 6(*a*);

FIG. 7 is a detail view, partially cut away, showing the connection between the handle portion and the paint application portion;

FIG. 8(*a*) is an end view of the paint handle portion showing the hexagonal recess for receiving the paint application portion;

FIG. 8(*b*) is a detail side view of the recess shown in FIG. 8(*a*); and FIG. 9 is a detail section through opposite sections of a handle, showing a recess and projection for initially joining of the sections to each other.

DETAILED DESCRIPTION OF THE PREFERRED EMBODIMENTS

Reference is now made to the drawings which show various embodiments of the paintbrush of the invention, including different forms of handle portions and paint application portion which may be attached thereto.

In this specification, any reference to "paintbrush" includes a painthead portion which includes not only bristles to form a brush, but also includes a head which may comprise a variety of different media which can hold paint, and which are capable of applying that paint to a surface.

With reference to FIGS. 1 and 4 of the drawings, there is shown the handle portion of the paintbrush assembly. In FIG. 1, the handle portion includes illustration of the bolt and end knob, while FIG. 4 shows the basic molded handle portion without any of its attachments. In FIG. 4, the handle portion, having reference numeral 10, comprises a stem 12 having a head end 14 and a knob end 16. The stem 12 is generally contoured, with rounded surfaces 108 to facilitate an easy grip thereon by the user, and presents no sharp edges which may cause discomfort. The contoured stem 12 is designed so as to take into account the fact that the brush will be held fairly tightly, and for extending periods of time, and so will be configured and designed to maximize comfort.

The head end 14 has extending inwardly from the end surface 20 a recess 18. The recess 18, which is preferably of hexagonal cross-section, as best seen in FIGS. 8(*a*) and 8(*b*), has a wider diameter at the end surface 20, and tapers slightly as its side walls 22 approach a base end 24 of the recess. This recess 18 may be lined with metal, a hard plastic or other material so as to enhance the attachment of the handle portion 10 to the paint application cartridge, as will be described below.

The stem portion 12 has an axial channel 26 extending along the entire length of the handle portion 12, from the end surface 28 through to the base end 24 of the recess 18. The channel 26 has a wider diameter central portion 30, a narrower head end portion 32 on one side thereof, and a narrower knob end portion 34 at its other end. A step 36 of bevel shape is located between the central portion 30 as it transitions to the head end portion 32, while step 38 is located between the central portion 30 as it transitions to the narrower knob end portion 34 of the channel 26. A retainer ring groove 40, coaxial with the knob end portion 34, surrounds the channel 26, and is adapted to accommodate a retainer ring on the bolt.

The handle portion 10 may be constructed of any suitable and convenient material, including but not limited to wood, polyurethane, PVC, or other plastics material. In one preferred form, the material may be selected for its ability to have paint more easily removed therefrom by paint thinners and removers.

With reference to FIGS. 1 and 2 of the drawings, it will be noted that an elongate bolt 44 is located within the channel 26, and is of a length such that the bolt extends outside the channel 26 beyond both the end surface 28 and the base 24 of the recess 18. The diameter of the bolt 44 is just slightly less than, or substantially the same as, the diameter of the head end portion 32 and knob end portion 34 of the channel 26, so that it is received snugly therein. The bolt may move slightly within the head end portion 32 and knob end portion 34, but the tolerance levels will be high so that side to side movement of the bolt within these end portions is minimal or substantially zero.

The bolt 44 includes a disc-shaped retainer ring 46 affixed thereto, the retainer ring 46 being received and accommodated within the retainer ring groove 40. The presence of the retainer ring 46 within the groove 40 has the effect of fixing the bolt 44 within the channel 26 so that axial movement therethrough is prevented.

The bolt has a smooth cylindrical surface 48 along substantially its entire length, but terminates in a threaded end 50, the threaded end being essentially contained, in use, within the recess 18. The threaded end 50 terminates with a pointed tip 52. In a preferred embodiment, the pointed tip 52 reaches to approximately the level of the end surface 20, or just below, and will typically not extend outward beyond the end surface 20, and outside the recess 18.

The bolt 44 is essentially an elongate cylindrical unthreaded member, with a threaded end 50 at that portion of the bolt 44 which extends into and is contained within the recess 18. The retainer ring 46 prevents axial movement of the bolt 44 within the channel 26, although rotational movement of the bolt about its axis while contained in the channel 26 is fully permitted. This rotational movement is indeed not only permitted, but necessary to enable the threaded end 50 of the bolt 44 to engage the paint applicator cartridge, as will be discussed below.

The handle portion 10 further comprises a knob 56 which is located adjacent the end surface 28 at the knob end portion 34 of the handle 10. The knob 56 has a flat end surface 58 which is flush with, although not connected to, the end surface 28. The knob 56 includes a groove 60 having an open end 62 and a closed end 64. The groove 60 is of substantially the same diameter as the bolt 44, and is adapted to receive and accommodate that end of the bolt 54 which extends beyond the end surface 28, outside of the handle portion 10. The bolt, at its knob end 66 has a pair of diametrically opposed projections 68 extending from the surface thereof. The knob end 66 of the bolt is received in the knob 56, which is molded about the knob end 66 of the bolt to fix therein, and the knob 56 cannot move relative to the bolt 44. Since, in use, the knob 56 will be rotated in different directions to attach and release the paint applicator cartridge, as will be discussed below, an effective fastening between the knob 56 and the knob end 66 of the bolt 44 is required. The projections 68 help to enhance this attachment, since the projections 68 are embedded in the knob 56 to strengthen the connection therebetween.

Preferably, the outer wall 70 of the knob has a ribbed or textured surface to facilitate a tighter hold thereon by the user.

Reference is now made to FIG. 5 of the drawings, which shows a paint application cartridge which is adapted to connect with the handle portion 10 of the paintbrush assembly.

The paint application cartridge, designated by reference numeral 74 essentially comprises a based holder 76 and a brush 78 connected thereto. FIG. 5(*a*) shows a brush 78 as the medium of the paint applicator, but it must be appreciated that the invention is not confined to a paint application cartridge 74 having a brush. For example, instead of the brush, the paint applicator may be a sponge, fabric, or other textured medium. Furthermore, the paint applicator may be of any suitable shape, such as rectangular, or even a roller mounted in the base holder 76. In the embodiment shown in FIG. 5(*a*), the paint applicator is a brush 78 comprised of a plurality of synthetic or natural bristles held together at their base 80. The bristles are all held together at base 80 in a conventional manner such as by glue, being embedded in a matrix, being tightly held together, or one or more of these arrangements.

In FIG. 5(*a*), a brush having a width of approximately one inch is shown, with a narrower edge. FIG. 6(*a*) shows essentially the same paint application cartridge 74, but with a brush width of approximately four inches, and a slightly increased thickness. It will be appreciated that any desired brush width may be used, and the paint application cartridge 74 is not confined to the dimensions shown in FIGS. 5 and 6. While the structure of each paint application cartridge 74 is based on the same principles, the dimensions thereof may be changed to suit the particular circumstances, as required by the job.

The base holder 76 comprises a cup-shaped member 82 having side walls 84 and a base wall 86. The base wall 86 and side walls 84 define a chamber 88 in which the brush 78 is received. The brush 78, which has a fixed bristle section 90 and a loose bristle section 92, is inserted into the cup-shaped member 82 such that the fixed bristle section 90 occupies the chamber 88. Any suitable or conventional means for permanently fixing the brush 78 within the cup-shaped member 82 may be used to ensure that the brush 78 remains in the cup-shaped member 82 during painting. Since the painting action imparts some significant forces to the brush_78, which is subject to repeated and multiple back and forth movements, it must be ensured that the brush 78 is firmly fixed within the cup-shaped member 82.

The cup-shaped member 82 has an outer end wall 94 to which is attached a connector 96. The connector has a wider diameter 98 at its end near the outer end wall 94, and tapers down to a slightly narrower diameter 100, terminating in a connector end 102. The connector end 102 is generally a flattened end, while the side wall 103 of the connector 96 is of hexagonal shape. The shape and dimensions of the connector 96 are designed so that it registers with and corresponds to the shape of the recess 18 in the head end 14 of the handle 10.

The connector 96 further comprises a threaded groove 104 which is structured so as to be capable of matingly engaging with the threaded end 50 of the bolt 44.

In use, one of any of a number of variety of different paint application cartridges 74 may be attached to the handle portion 10. The paint application cartridge 74 is placed adjacent the handle portion 10 such that the connector 96 is positioned over the recess 18. As the connector 96 is lowered into the recess 18, the pointed tip 52 of the bolt, and thereafter the threaded end 50 thereof, will contact the threaded groove 104 in the connector 96, and the outer thread of the end 50 will matingly engage the internal thread in the groove 104. The pointed tip 52 may be useful in centering of the connector 96 within the recess 18.

The paint application cartridge 74 is then drawn into the recess 18 by rotating the knob 56. Rotation of the knob 56 correspondingly rotates the bolt 44 and the threaded end 50, and the threaded end engages the internal threads of the groove 104. The continued rotation of the knob draws the connector 96 into the recess 18. The fit of the connector 96 within the recess 18 is a tight one, facilitated by the engagement of the hex-shaped side wall 106 with the hex-shaped side wall 22 in the recess. These shaped surfaces, ensure that the paint application cartridge 74 will be incapable of rotating relative to the handle portion, thus adding to the secure attachment between the paint application cartridge 74 and the handle 10. The tapering nature of the connector 96, and the corresponding tapering of the recess 18, also facilitates the connection, and assists the user in placing the connector 96 relative to the handle since it is easier to center or place the narrower diameter portion 100 of the connector in the sightly larger diameter at the end surface 20 of the handle 10.

The knob 56 continues to be turned until such time as the connector end 102 firmly approaches or abuts the base end 24 in the recess 18. At this point, the paint application cartridge 74 is firmly connected to the handle 10, and the paint brush assembly is ready for use in a painting job.

When the paint application cartridge 74 currently in use and located on the handle is no longer required, or the painter wishes to use a different shape, textured or size paint application cartridge 74, the connected paint application cartridge 74 can simply be removed by rotating the knob 56. Rotation of the knob causes disengagement of the threaded portions at the end of the bolt, and has the effect of forcing the cartridge out of the recess. When the threaded portions are no longer in contact, the connector end 102 of the connector 96 will be pushed above the level of the end surface 20, and simply fall out of the handle. This is a convenient method of removal, since the user does not need to tug or force the cartridge out of the recess, with the possibility of spraying paint, paint running onto the fingers etc. Further, a tight fit between the paint application cartridge 74 within the recess is necessary for the stability of the paintbrush assembly, but at the same time, this tight fit should not interfere with the ability to remove the painthead cartridge 74 at the desired time. The bolt-type connection, and the axial fixing of the bolt 44 within the channel 26 assures, on the one hand, the necessary tight fit, but also on the other hand, ease in releasing or removing the painthead cartridge 74 from the recess 18.

FIG. 8(*a*), which is an end view of the handle portion 10, clearly shows the hexagonal-shaped contours of the recess 18. As has been described, the recess 18 (and the connector 96) both taper, and, in a preferred embodiment, the amount of taper is approximately 7° from the perpendicular axis. In FIG. 8(*b*), which shows a detail of the recess 18, this degree of taper is illustrated.

FIG. 9 shows a detail of the male/female type connection between opposing sections in one embodiment of a handle. Each half, or opposing section, of the handle is injection molded and one section incorporates a projection while the opposing section has a corresponding recess. When initially bringing the two sections together, the projection is received within the recess for accurate alignment of the two sections, which may then be heat treated or otherwise processed to permanently hold the two sections together.

The handle may include a textured and specially shaped portion to facilitate a proper grip of the handle by the user. The textured portions may comprise a plurality of fine grooves which are substantially parallel to each other to give the handle a "matted" or roughened feel so that it is less likely to slip or slide in the hand of the user. The shape of the handle may also be designed and contoured for maximum comfort, since the handle may be held for prolonged periods.

The invention is not limited to precise details described above and/or illustrated in the drawings. Variations of the basic mechanism and design are also within the scope of the invention.

What is claimed is:

1. A paintbrush comprising:

a handle portion including a stem portion having a channel and a head portion, the head portion having a receiving means thereon including fastening means in the channel;

a paint application cartridge having a paint application portion, a holding means for holding the paint application portion, and a connecting means whereby the paint application cartridge can be releasably connected to the receiving means of the handle portion, the fastening means being movable within the channel to engage with or release from the connecting means;

wherein the receiving means comprises: a recess in the head portion, and the fastening means in the recess for releasable connection to the connecting means.

2. A paintbrush as claimed in claim 1 wherein the fastening means comprises a bolt located in the handle portion, the bolt having a threaded end which engages with the connecting means of the paint application cartridge.

3. A paintbrush as claimed in claim 2 wherein the channel extends from the receiving means at the head portion to an opposite end of the head portion, with the bolt being located in the channel.

4. A paintbrush as claimed in claim 3 wherein the bolt further comprises a ring portion thereon, the ring portion permitting rotational movement of the bolt within the channel, but preventing axial movement of the bolt therein.

5. A paintbrush as claimed in claim 4 wherein the handle portion further comprises a knob connected to the bolt at an end thereof remote from the threaded portion, whereby rotation of the knob causes rotation of the bolt and the subsequent attachment to or release from the connecting means of the paint application cartridge.

6. A paintbrush as claimed in claim 5 wherein the bolt has means for securement thereof to the knob.

7. A paintbrush as claimed in claim 6 wherein the securement means comprises at least one projection extending radially outwardly from the bolt, with the knob being molded around the projection.

8. A paintbrush as claimed in claim 1, wherein the recess is hexagonal in cross-section, and tapers from a wide end portion at the point where the recess is open, to a narrower end portion at an opposing end of the recess.

9. A paintbrush as claimed in claim 1 wherein the paint application portion comprises a medium selected from the group consisting of: nylon bristles, synthetic bristles, natural bristles, and fabric.

10. A paintbrush as claimed in claim 1 wherein the paint application cartridge has a paint application portion which is a brush.

11. A paintbrush as claimed in claim 1 wherein the paint application cartridge has a paint application portion which is a roller.

12. A paintbrush as claimed in claim 1 wherein the holding means comprises a cup-shaped member having side walls and a base which define a chamber, with a portion of the paint application portion being located within the chamber.

13. A paintbrush as claimed in claim 12, wherein the connecting means comprises a connector piece extending from the base wall of the cup member in a direction away from the chamber.

14. A paintbrush as claimed in claim 13 wherein the connector piece has a central groove therein having an internal thread, the groove receiving a threaded bolt member which forms part of the receiving means.

15. A paintbrush as claimed in claim 14 wherein the connector piece is of hexagonal shape, and tapers from a wider diameter portion at a point near the cup-shaped member to a narrower diameter portion at a point remote from the cup member.

16. A paintbrush as claimed in claim 3, wherein the channel comprises a central portion having a diameter slightly wider than the bolt and two end portions each having a diameter substantially the same as the bolt.

17. A paintbrush as claimed in claim 4 wherein the handle portion further includes a retaining ring groove, wherein the ring portion on the bolt is accommodated.

18. A paintbrush as claimed in claim 5 wherein the knob has an outer surface which is textured.

19. A paintbrush handle connectable to a paint applicator having a connecting member thereon, the paintbrush handle comprising:

a stem portion having a channel and contoured for holding by a user of the paintbrush handle;

a head, portion at one end of the stem portion, the head portion having a receiving member including fastening means in the channel for receiving the connecting member of the paint applicator; and the fastening means within the receiving member being movable for releasably attaching to the connecting member.

20. A paintbrush handle as claimed in claim 19 wherein the receiving means comprises: a recess in the head portion, and the fastening means in the recess portion for releasable connection to the connecting means.

21. A paintbrush handle as claimed in claim 20 wherein the fastening means comprises a bolt located in the handle portion, the bolt having a threaded end which engages with the connecting member of the paint applicator.

22. A paintbrush handle as claimed in claim 21 wherein the channel extends from the receiving member at the head portion to an opposite end of the head portion, with the bolt being located in the channel.

23. A paintbrush handle as claimed in claim 22 wherein the bolt further comprises a ring portion thereon, the ring portion permitting rotational movement of the bolt within the channel, but preventing axial movement of the bolt therein, and the handle portion further includes a retaining ring groove, wherein the ring portion on the bolt is accommodated.

24. A paintbrush handle as claimed in claim 23 wherein the handle further comprises a knob connected to the bolt at an end thereof remote from the threaded portion, whereby rotation of the knob causes rotation of the bolt and the subsequent attachment to or release from the connecting means of the paint application cartridge.

25. A paintbrush handle as claimed in claim 24 wherein the bolt comprises at least one projection extending radially outwardly from the bolt, with the knob being molded around the projection.

26. A paintbrush handle as claimed in claim 20, wherein the recess is hexagonal in cross-section, and tapers from a wide end portion at that point where the recess is open, to a narrower end portion at the opposing end of the recess.

27. A paintbrush handle as claimed in claim 22, wherein the channel comprises a central portion having a diameter slightly wider than the bolt and two end portions each having a diameter substantially the same as the bolt, thereby holding the bolt in a fixed position.

* * * * *